US008995238B2

(12) United States Patent
Fracheboud

(10) Patent No.: US 8,995,238 B2
(45) Date of Patent: Mar. 31, 2015

(54) DEVICE FOR DISPLAYING TIME INFORMATION

(71) Applicant: Rolex S.A., Geneva (CH)

(72) Inventor: Blaise Fracheboud, Plan-les-Ouates (CH)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 14/220,298

(22) Filed: Mar. 20, 2014

(65) Prior Publication Data

US 2014/0293757 A1 Oct. 2, 2014

(30) Foreign Application Priority Data

Mar. 28, 2013 (EP) ..... 13161772

(51) Int. Cl.

| | |
|---|---|
| ***G04B 19/04*** | (2006.01) |
| ***G04B 19/02*** | (2006.01) |
| ***G04B 19/08*** | (2006.01) |
| ***G04B 19/25*** | (2006.01) |
| ***G04B 19/26*** | (2006.01) |

(52) U.S. Cl.

CPC ..... *G04B 19/02* (2013.01); *G04B 19/082* (2013.01); *G04B 19/25* (2013.01); *G04B 19/268* (2013.01)

USPC ..... 368/228; 368/28

(58) Field of Classification Search

USPC ..... 368/27, 37, 129, 132–133, 223, 228, 28

See application file for complete search history.

(56) References Cited

U.S. PATENT DOCUMENTS

| | | | | |
|---|---|---|---|---|
| 4,674,889 | A | 6/1987 | Klaus | |
| 7,625,116 | B2 | 12/2009 | Bron et al. | |
| 7,645,068 | B2 * | 1/2010 | Mahler et al. | 368/185 |
| 7,817,501 | B2 * | 10/2010 | Groothuis | 368/220 |
| 8,730,768 | B2 * | 5/2014 | Goeller | 368/66 |
| 2008/0106979 | A1 | 5/2008 | Bron et al. | |
| 2012/0243381 | A1 * | 9/2012 | Goeller et al. | 368/34 |
| 2013/0182543 | A1 * | 7/2013 | Crettex | 368/220 |
| 2014/0022874 | A1 | 1/2014 | Tran et al. | |

FOREIGN PATENT DOCUMENTS

| | | | |
|---|---|---|---|
| CH | 159199 | A | 12/1932 |
| CH | 331410 | A | 7/1958 |
| CH | 702137 | B1 | 5/2011 |

(Continued)

OTHER PUBLICATIONS

European Search Report (ESR) dated Sep. 27, 2013, issued in corresponding application No. EP 13161772.2.

*Primary Examiner* — Sean Kayes

(74) *Attorney, Agent, or Firm* — Westerman, Hattori, Daniels & Adrian, LLP

(57) ABSTRACT

A device (100) for displaying time information with the aid of an indicator member (1), including a cam (2) the profile of which includes a flank (23);

a lever (4) driving the indicator member (1);

a follower (3) controlling the lever (4), pressed against the cam (2) by first spring means (6), adapted, during movement of the flank (23) in a first direction of movement of the cam (2), to control movement of the lever (4) intended to drive movement of the indicator member (1), characterized in that the follower (3) controlling the lever (4) is adapted to be moved relative to the lever (4) against the return action of second spring means (5) by an action force (F) exerted by the flank (23) of the cam (2) on the follower (3) during movement of the flank (23) in a second direction of movement of the cam (2).

20 Claims, 9 Drawing Sheets

(56) References Cited

FOREIGN PATENT DOCUMENTS

| | | | |
|---|---|---|---|
| EP | 0191921 | A2 | 8/1986 |
| EP | 1918792 | A1 | 5/2008 |
| WO | 2012/127054 | A1 | 9/2012 |

* cited by examiner

DEVICE FOR DISPLAYING TIME INFORMATION

The invention concerns a device for use in a timepiece to display time information with the aid of an indicator member.

In some display devices, known as "retrograde" devices, the display is not circular. Instead of effecting a complete revolution, the indicator member follows a path from a departure point A to an arrival point B in front of graduations representing a time related quantity. Once it has followed the path from A to B, the indicator member returns to the point A backwards and instantaneously. This type of display may be used for any type of time related quantity, for example seconds, minutes, hours, dates, days of the week or phases of the moon.

A retrograde display device generally comprises a spiral or snail-shaped cam the profile of which features a steep flank. A lever is pressed against the cam by a follower. A return spring presses the lever against the cam. The lever includes a toothed portion or rack designed to mesh with and to drive a pinion driving the indicator member.

In normal operation (i.e. in the time related quantity display phase), rotation of the cam in a first direction corresponding to the clockwise direction causes the indicator member to be driven from its departure position A, in which the follower is in a low position at the base of the flank of the cam, to its arrival position B, in which the follower is in a high position at the top of the flank of the cam. The cam continues to rotate when the follower reaches the high position. The follower then goes from its high position to its low position instantaneously, causing the indicator member to return to the departure point A.

The presence of this steep flank poses a problem when it is required to correct the time information "in reverse" (i.e. in the counter-clockwise direction). In fact, when the follower reaches the base of the steep flank, this causes jamming or even breaking of the components. It is therefore necessary to prohibit this type of correction.

The document EP1918792 describes a timepiece provided with a conventional retrograde display device including a snail-shaped cam and a retrograde display lever in contact with the cam profile via a follower. The display lever drives a hand indicating a time related quantity. A disconnecting device is added to the display device. In the correction phase, notably the reverse correction phase, the disconnecting device enables the follower of the retrograde display lever to be moved away from the path of the cam. Accordingly, in the reverse correction phase, the indicator hand is in a predetermined position and does not indicate a value of the time quantity. The disconnecting device therefore makes it possible to carry out a bidirectional correction of the display of the time related quantity at any time. However, during this adjustment, the correction effected is not visible to the user, which introduces the risk of inducing errors in the adjustment of the timepiece. Moreover, the disconnecting device requires a large number of components to be added to the conventional mechanism.

The object of the invention is to provide a device eliminating the aforementioned drawbacks and improving the known prior art devices. In particular, the invention proposes a simple, reliable and robust device enabling reverse correction of a retrograde system.

To this end, the invention concerns a display device as claimed in claim 1.

Thus the invention originates in a problem affecting retrograde display devices. However, the applicant does not intend to limit the scope of the application to this particular application example but to extend it to any type of display device including a cam with at least one flank and a control follower designed to ascend that flank.

When the follower ascends the cam flank, the flank exerts an action force on the follower. The effect of this action force on the follower is to move it relative to the lever, against the return action of the second spring means, and thereby to prevent damage to the mechanism. In other words, the invention proposes to interpose second spring means between the follower and the lever to enable movement of the follower relative to the lever when ascending the flank. These second spring means are of course separate from the first spring means adapted to urge the lever against the cam via the follower. On movement of the follower relative to the lever, the follower moves toward the lever and is therefore retracted, against the return action of the second spring means.

The action force exerted by the flank of the cam on the follower when the flank moves in the second direction of movement of the cam advantageously acts to bring about immobilization of the lever.

Accordingly, when the follower ascends the flank, the action force exerted on the follower by the cam flank produces a second effect: this force acts on the lever to bring about immobilization thereof.

The action force advantageously acts on the lever to cause pivoting thereof against a stop.

Accordingly, the action force of the flank on the follower causes a pivoting effect of the lever. This pivoting is effected against a stop, which acts to cause a stable immobilization of the lever.

In one particular embodiment, the lever being adapted to pivot about a pivot point, the action force passes substantially through said pivot point of the lever. In this case, the drive lever including an arm for driving the indicator member, an action angle defined by the action force of the cam on the follower and the line segment connecting the point of contact of the follower and the cam flank and the pivot point of the lever is advantageously located in the half-plane defined by the line segment containing said segment and not containing the arm driving the lever.

The line segment containing the point of contact between the follower and the cam and the pivot point of the lever defines two half-planes, one containing the arm driving the lever, the other not containing said arm. Positioning the action angle in the half-plane that does not contain the lever arm has the effect of producing a force tending to cause the lever arm to pivot in the appropriate direction to immobilize it against the stop.

In one particular embodiment, said action angle is between 0 and 180°.

The stop therefore has a two-fold function:

- on the one hand, it immobilizes the lever at the base of the cam flank at the end of the follower descending the flank during movement of the cam in the first direction;
- on the other hand, it immobilizes the lever when the follower ascends the flank during movement of the cam in the second direction.

The invention therefore cleverly employs the stop for immobilizing the lever at the end of the descent of the flank also to immobilize the lever during the ascent of the flank.

In one particular embodiment, said stop is adapted to immobilize the lever when the follower reaches the base of the flank during movement of the cam in the first direction.

The head of the follower is therefore conformed to bring about continuous contact between the follower and the cam flank throughout the movement of the follower along the cam flank during the ascent of the cam flank.

The geometry of the follower is advantageously adapted so that there is no contact between the tip of the follower and the flank when the follower moves from the top of the cam flank to the base of the cam flank.

In another embodiment, the follower comprises a head flank conformed to bring about continuous contact between the flank of the follower and the top end of the cam flank (i.e. the end located at the level of the cam portion with the largest radius) while the follower is ascending the cam flank.

The cam having a snail-shaped profile, the follower advantageously comprises a head provided with a contact tip and a contact flank and is adapted to be in contact:

with the flank of the cam via said tip of the follower head, and with at least a portion of the snail-shaped profile of the cam via the flank of the follower head.

The follower is advantageously pivotably mounted on the lever.

Thanks to this, the follower can pivot relative to the lever without butting.

An angle defined by the normal to the cam at the point of contact between the follower and the cam flank and the half-segment originating at the location of said contact and passing through the pivot point of the follower is advantageously greater than the angle defined by the normal at the location of the contact between the follower and the cam flank and the reaction force exerted by the follower on the flank. During movement of the cam in the first direction, which corresponds to normal operation of the display device, the second spring means are slightly deformed because of the action of the cam on the follower. This deformation causes an offset in the display of the time information compared to a display provided by an assembly including a follower rigidly mounted on a lever. This offset is compensated by adapting the cam profile. The modified, adapted cam profile enables a perfectly rigid assembly to be simulated and produces a perfectly accurate display.

In one particular embodiment, movement of the cam in the first direction prestresses the second spring means, which prestressing is compensated by a cam profile conformed to ensure accurate display of the time information.

In a first embodiment, the second spring means comprise a flexible blade or leaf spring. This minimizes the number of components and reduces the overall size of the mechanism. Furthermore, this makes it possible to prevent balancing defects liable to occur within an assembled lever.

The lever, the second spring means and the follower are advantageously made in one piece. The lever is advantageously fastened to a toothed portion adapted to cooperate with the teeth of a pinion for driving the indicator member.

The toothed portion may comprise play-compensating teeth.

The play-compensating teeth make it possible to minimize display errors. They further make it possible to limit shocks and to attenuate the effects of inertia when the time indicator member returns suddenly to the initial position.

The lever may be made from one of the materials from the group comprising Ni, NiP and Si.

The invention also concerns a clock movement including a display device as defined above.

The invention further concerns a timepiece incorporating the display device defined above or the clock movement defined above.

The timepiece may comprise a basic movement and a display device as defined above, the cam of the display device being driven by the basic movement.

The invention will be better understood with the aid of the following description of a number of particular embodiments of the display device of the invention, given with reference to the appended drawings, in which.

It will be noted that, for clarity, corresponding elements shown in different figures bear the same references, unless otherwise indicated.

Figure 1:
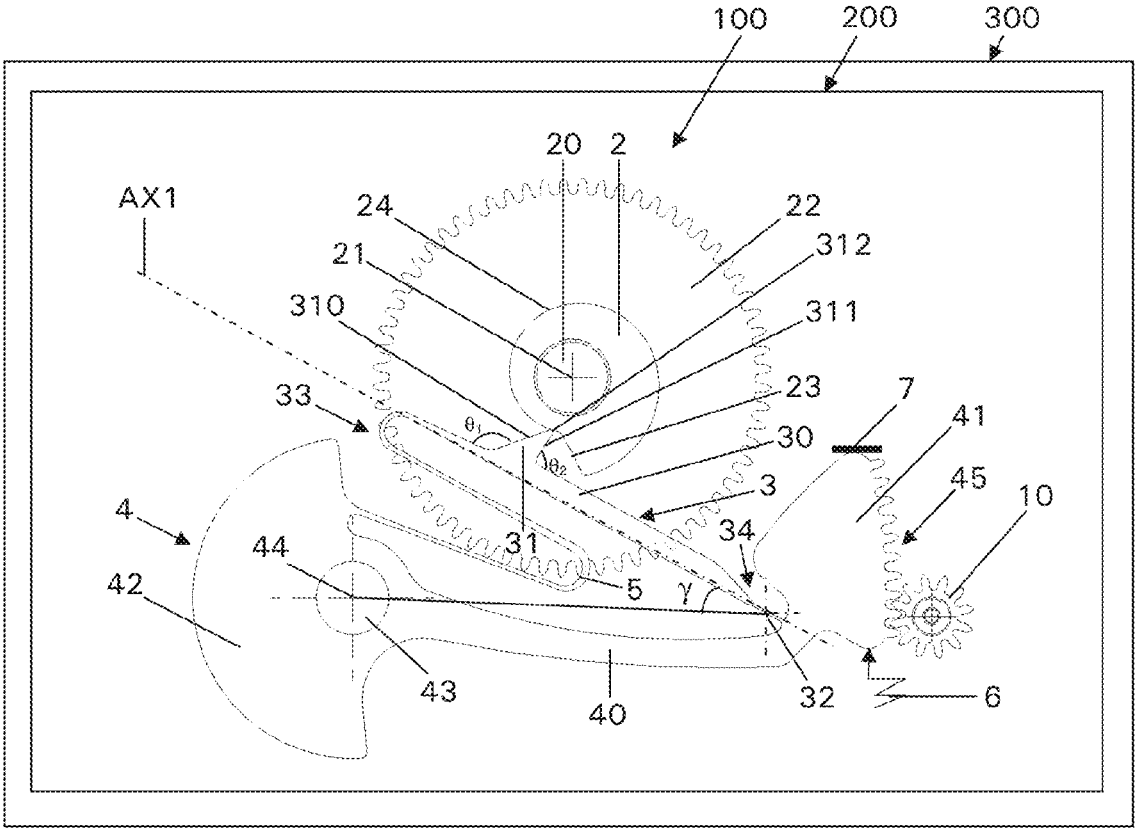
FIG. 1 shows the display device of a first embodiment of the invention for a retrograde display of the hour between 0 h and 24 h (midnight)

A display device in accordance with a first embodiment of the invention is shown in FIG. 1, which shows a timepiece 300 of one embodiment of the invention. The timepiece includes a clock movement 200. The clock movement includes the display device 100. This display device is designed to be integrated into a clock movement of a timepiece.

The FIG. 1 display device 100 is designed to drive an indicator member 1, here an indicator hand, indicating a time related quantity (i.e. time information). The hand 1 is seen notably in FIGS. 2A, 3A and 4A. In the particular example shown in these figures, the time related quantity is the hour represented on a graduated scale of 24 hours covering an angular arc of 180°. In the time display phase, the forward path of the hand 1 goes from a "0 h" position to a "24 h" position. The hand 1 is designed to return instantaneously from the "24 h" position to the "0 h" position at midnight.

The invention could of course be applied to any type of time related quantity (seconds, minutes, dates, days of the week, phases of the moon, etc.), to a retrograde display represented on any angular arc, and to a non-retrograde display, as explained in more detail at the end of the description.

Referring to FIG. 1, the display device includes a cam 2, a follower 3 and a lever 4.

Figure 2A:
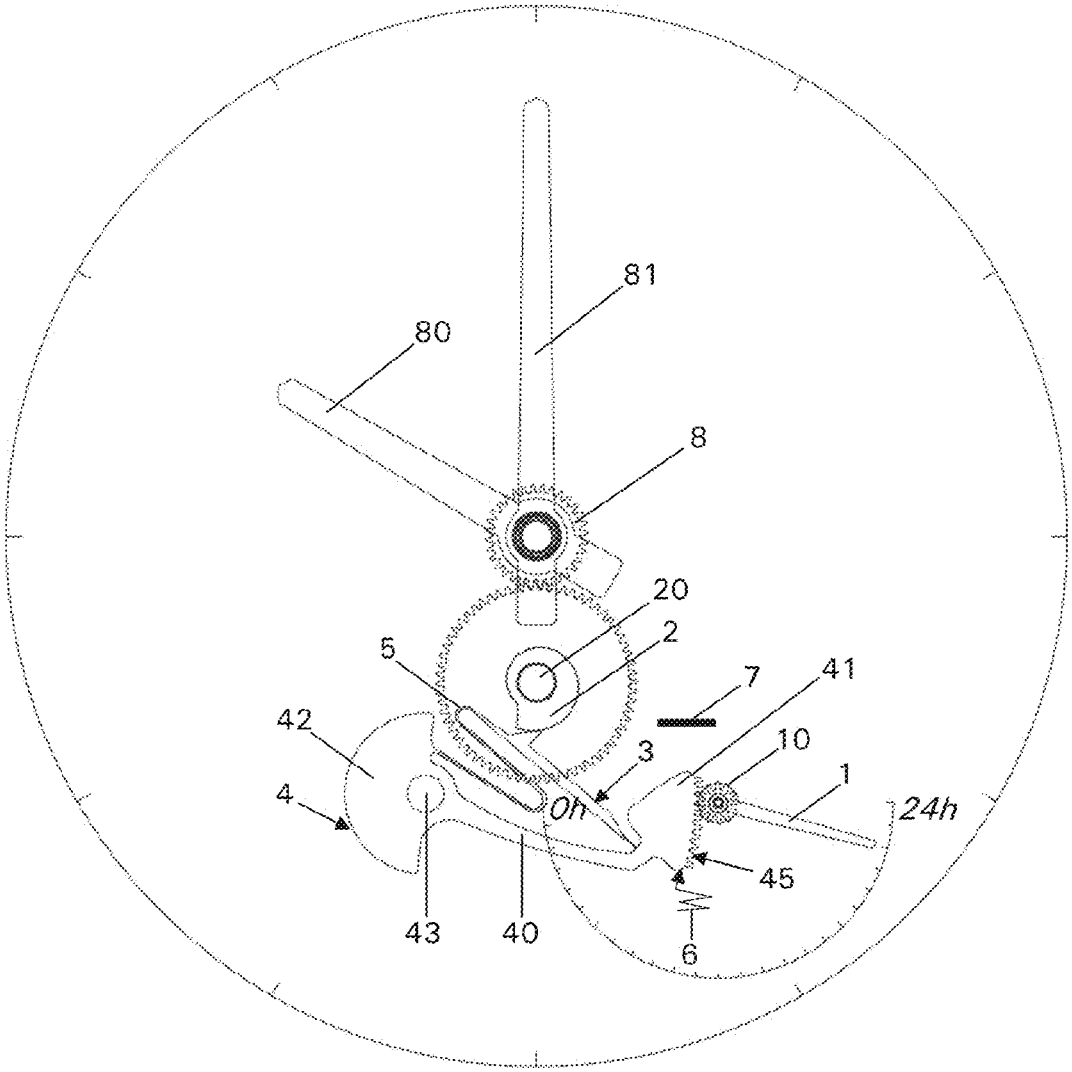
FIG. 2A shows the display device from FIG. 1 at 22 h.
Figure 3A:
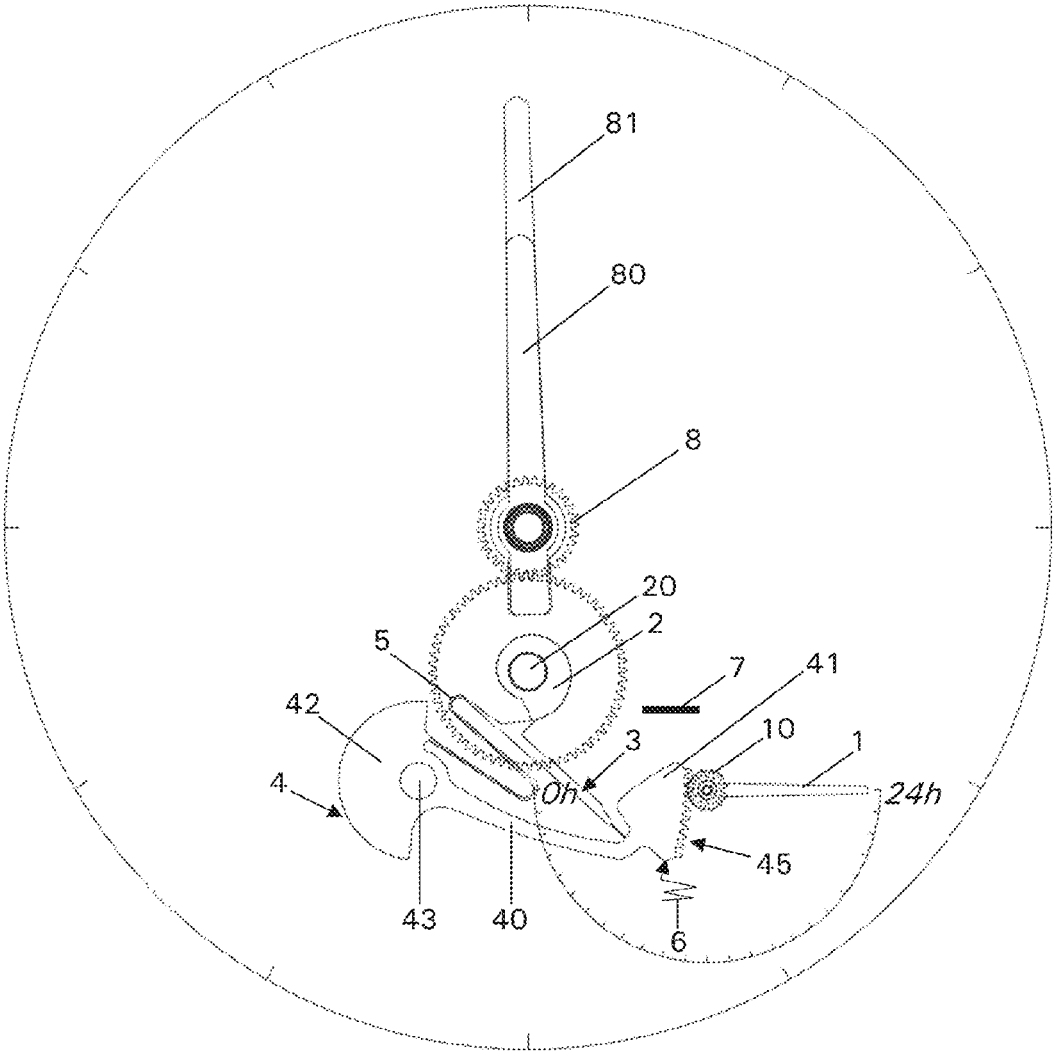
FIG. 3A shows the display device from FIG. 1 just before midnight.
Figure 4A:
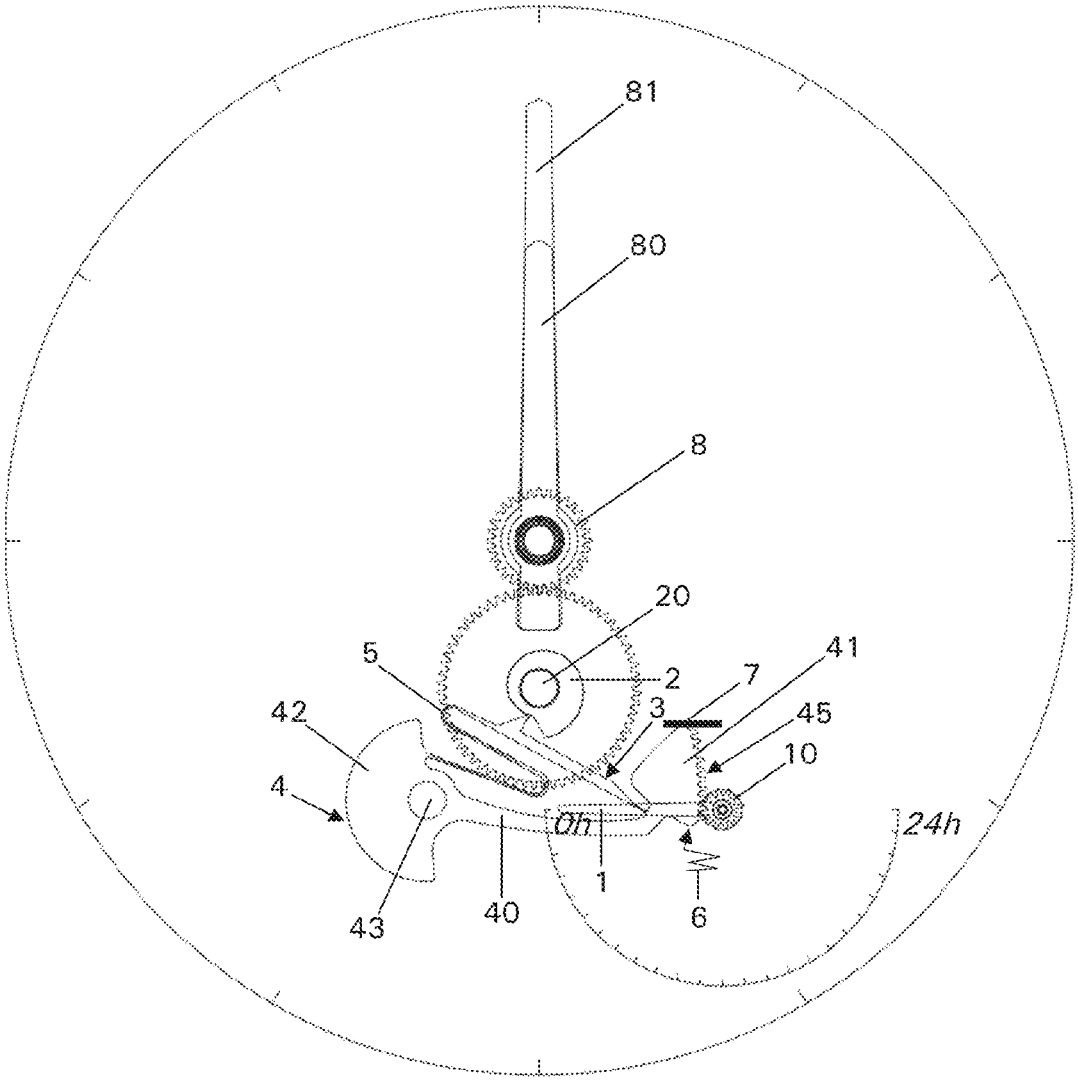
FIG. 4A shows the display device from FIG. 1 at midnight.

The cam 2 is snail-shaped with a spiral profile and is mounted on a shaft 20 to rotate about a rotation point 21. The spiral profile of the cam 2 is referenced 24. The cam 2 is kinematically coupled to a basic movement of the timepiece by way of a wheel 22 meshing with a drive wheel 8, for example driving a circular hour indicator hand 80, as shown in FIGS. 2A, 3A and 4A. In a plane perpendicular to its rotation axis 21, the profile 24 of the cam 2 corresponds at least substantially to part of an Archimedes spiral. The cam 2 has a flank 23 connecting the cam portion with the smallest radius and the cam portion with the largest radius. In normal operation (i.e. during the time display phase), the function of the flank 23 is to return the indicator hand 1 to the initial "0 h" position when the "24 h" final position is reached.

The lever 4 includes an arm 40, a toothed portion 41 and a counterweight portion 42. The lever 4 is pivotably mounted on a shaft 43, pivoting about a pivot point 44. The pivot shaft 43 of the lever 4 and the rotation shaft 20 of the cam 2 are fixed relative to each other.

Figure 10:
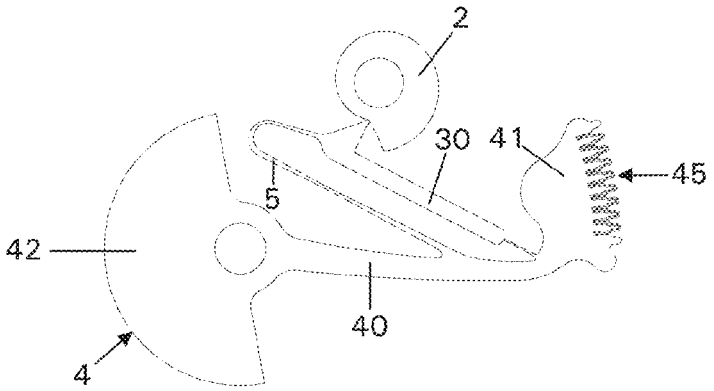
FIG. 10 shows part of the display device of a second embodiment of the invention.
Figure 11:
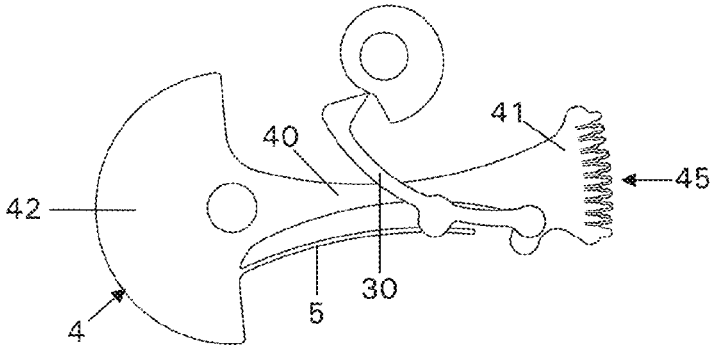
FIG. 11 shows part of the display device of a third embodiment of the invention.

The toothed portion 41 is joined to the end of the arm 40 opposite the shaft 43. It meshes with the teeth of a pinion 10 driving the hand 1. In other words, the lever 4 carries the toothed portion 41 designed to cooperate with the pinion driving the indicator member. In the particular example described here, the toothed portion and/or the pinion 10 may have play-compensating teeth 45 so as to minimize display errors in the indication provided by the display device. One example of play-compensating teeth usable in the invention is notably described in the document EP2112567. FIGS. 10 and 11 show embodiments of play-compensating teeth 45. The teeth are adapted so that they mesh in the "0 h" and "24 h" positions.

The counterweight portion 42 is of semicircular general shape and is located on the opposite side of the pivot shaft 43 to the arm 40. The counterweight 42 is adapted so that the center of mass of the lever 4 and its pivot point 44 at least substantially coincide.

The follower 3 includes an arm 30 and a head 31.

The arm 30 extends along a longitudinal axis AX1 shown in FIG. 1 in the vicinity of and generally along the arm 40. It has two ends 33, 34, respectively near the counterweight portion 42 of the lever 4 and near the toothed portion 41. The end 34 and the end 33 are fastened to the arm 40 and a flexible blade (or leaf spring) 5, respectively. The arm 30 pivots on the lever 4 at a pivot point 32 situated in the vicinity of the connection between the arm 30 and the lever 4. The angle defined by the longitudinal axis AX1 of the arm 30 and the line segment connecting the pivot point 32 of the follower 3 and the pivot point 44 of the lever 4, shown in FIG. 1, is denoted y.

The flexible blade 5 is curved and, with the arm 30, defines an S-shape. The end of the spring 5 opposite that fastened to the arm 30 is fastened to the counterweight portion 42. The flexible blade acts as a return spring 5 disposed between the follower 5 and the lever 4, against the action of which the follower 3 is pivoted by the cam 2, as explained in the description of operation.

The head 31 has a triangular profile (as seen perpendicularly to the rotation shafts 20 and 43) forming a contact tip 312. It includes a first flank 310 facing toward the end 33 and a second flank 311 facing toward the end 34. The flank 310 and the axis A1 define an angle $\theta_1$ and the flank 311 and the axis AX1 define an angle $\theta_2$, as shown in FIG. 1. Here the angle $\theta_1$ is an obtuse angle and the angle $\theta_2$ is preferably a right angle or an acute angle. In the particular example shown in FIG. 1:

the angle $\theta_2$ is of the order of 90°;

the angle $\theta_1$ is of the order of 130°.

It is emphasized here that the shape of the follower head shown in FIG. 1 in particular is merely one non-limiting illustrative embodiment. In any event, the follower head has a shape adapted to guarantee correct operation.

Figure 8A:
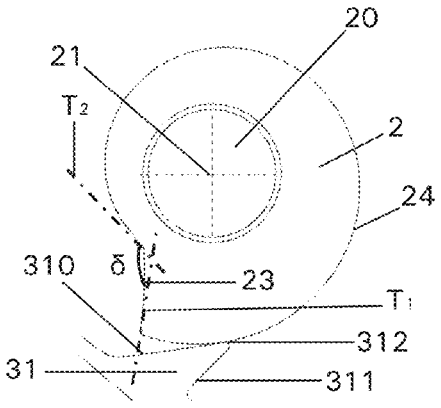
FIGS. 8A and 8B show the functional areas of the follower in contact with the cam during conventional operation of the display device from FIG. 1.
Figure 8B:
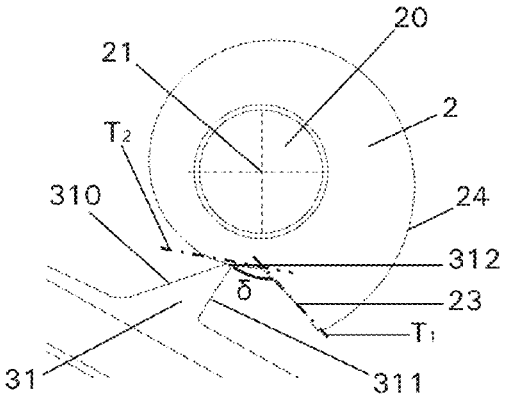

The follower head 31 is adapted to be in contact with the cam 2 either via the flank 310 or via the tip 312, as shown in FIGS. 8A and 8B. The contact flank 310 is designed to come into contact with a cam portion near the cam apex (i.e. the top of the flank 3, having the maximum cam radius), after ascent or before descent of the cam flank 23 by the follower 3, as explained later. The contact tip 312 is designed to be in contact with the rest of the cam profile 24, notably with the flank 23.

In the particular embodiment shown in FIGS. 8A and 8B, the tangent $T_1$ to the cam flank 23 passing through the top end of this flank 23 (i.e. the end of the flank located near the cam portion with the largest radius) and the tangent $T_2$ to the cam profile 24 at the bottom end point of this profile 24 (i.e. the point of the cam profile 24 with the smallest radius at the base of the cam flank 23) form a space delimited by an angle $\delta$ within which the follower head 31 can move. The angle $\delta$ is preferably an obtuse angle. In the particular example shown in FIGS. 8A and 8B, this angle 6 is at least of the order of 100°.

In the particular embodiment shown in FIG. 1, the lever 4 and the follower 3 are made in one piece. They may be made by one of the following techniques:

- by photolithography and electroforming of one of the materials from the group comprising Ni (nickel), NiP (nickel phosphorus) and Si (silicon);
- by photolithography and deep etching of silicon (Si).

A return spring 6 separate from the spring 5 disposed between the lever 4 and the follower 3 acts on the lever 4, here at the level of the toothed portion 41, to press the follower 3 against the cam 2. The spring 6 is adapted to load the lever 4 so that the lever 4 is pressed against the cam 2 by the follower 3 so that the follower 3 is pressed against the cam 2.

The display device also includes a stop 7, diagrammatically represented in the figures, having a two-fold function:

- it is adapted to immobilize the lever 4 when the follower 3 is at the base of the flank 23 when the cam 2 is driven in a first direction corresponding to the clockwise direction;
- it is adapted to immobilize the lever 4 when the follower 3 ascends the flank 23 when the cam 2 is driven in rotation in a second direction corresponding to the counter-clockwise direction and causes the lever 4 to pivot against the stop 7.

The operation of the display device in normal operation, on the one hand, and in the reverse or "counter-clockwise" correction phase, on the other hand, is described next with reference to FIGS. 2A to 7C.

Normal Operation:

Normal operation corresponds to the conventional display in the clockwise direction of time information, here the hour on a 24 h graduated scale covering an angular arc of 180°. It is described with reference to FIGS. 2A-2B, 3A-3B, 4A-4B.

It will be remembered that this is a particular illustrative example and that the invention applies to the display of any other time related quantity (day-night indication, minute, second, date, day of the week, etc.).

In normal operation, the cam 2 is driven in rotation in a first direction called the "forward" or "normal operation" direction, here the counter-clockwise direction. The follower head 31, pressed against the cam 2 by the return action of the spring 6, drives pivoting of the lever 4 in the clockwise direction, which here in turn drives movement of the hand 1 in the counter-clockwise direction. During rotation of the cam 2 in the counter-clockwise direction, the follower head 31:

- ascends the spiral cam profile 24 from its low position at the base of the flank 23 to its high position at the top of the flank 23 (i.e. at the apex of the cam 2);
- then goes from the apex of the cam 2 at the top of the cam flank 23 to the base of the cam flank 23.

The shape of the follower head 31 is adapted to prevent contact between the tip 312 of the follower head 31 and the cam flank 23 when the follower head 31 moves from the apex of the cam 2 to the base of the cam flank 23.

The follower head 31 ascending the cam profile 24 causes the hand 1 to move from the "0 h" position to the "24 h" position by rotating through 180° in the counter-clockwise direction. The movement from the apex of the cam 2 at the top of the cam flank 23 to the base of the cam flank 23 causes the hand 1 to return instantaneously to the "0 h" position.

FIGS. 2A, 3A and 4A show the display device in normal operation at respective different times, namely 22 h, just before midnight and just after midnight. A circular dial of the basic movement of the timepiece with hour and minute hands 80, 81 is also shown.

Figure 2B:
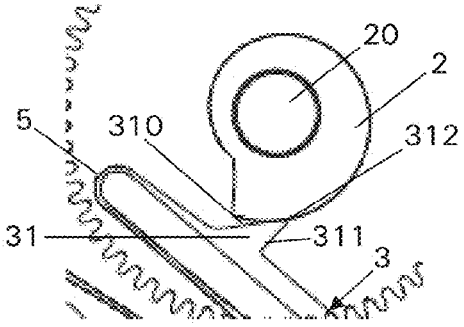
FIG. 2B shows a detail view of a follower and cam assembly from FIG. 2A.

FIG. 2A shows the display device at 22 h. The lever 4 has pivoted to position the hand 1 in front of the "22 h" indication on the graduated scale. FIG. 2*b* shows to a larger scale the cam 2 and the follower head 31 in this "22 h" position. Note that the flank 310 of the head 31 is in contact with the upper portion of the cam 2.

Figure 3B:
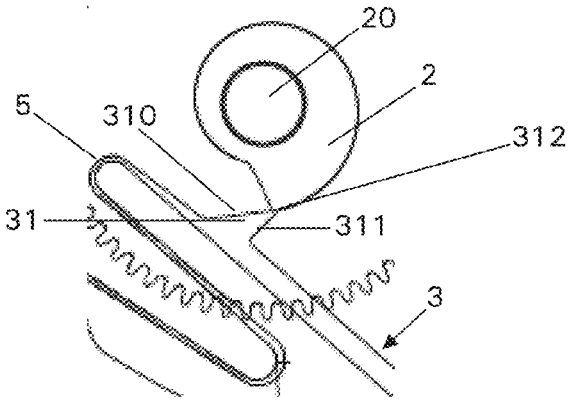
FIG. 3B shows a detail view of the follower and cam assembly from FIG. 3A.

FIG. 3A shows the display device at midnight (24 h) when the follower head 31 reaches the high position on the cam 2 at the top of the flank 23 just before the head 31 of the follower 3 goes from the top of the cam flank 23 to the base of the cam flank 23. FIG. 3B shows to a larger scale the cam 2 and the follower head in the "midnight" position. In this position, the hand 1 indicates "24 h". The contact tip 312 of the head 31 of the follower 3 bears against the apex of the cam 2.

Figure 4B:
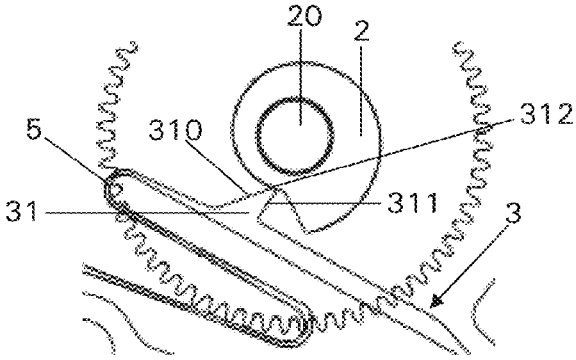
FIG. 4B shows a detail view of the follower and cam assembly from FIG. 4A.

FIG. 4A shows the display device just after midnight, the hand 1 indicating "0 h". This position is reached just after the follower head 31 moves from the top of the cam flank 23 to the base of the cam flank 23. FIG. 4B shows to a larger scale the cam 2 and the follower head 31 in the "0 h" position. As it descends the cam flank 23, driven by the follower 3, the lever 4 pivots in the counter-clockwise direction until it comes to bear against and is immobilized by the stop 7. The pivoting of the lever 4 causes the hand 1 to return instantaneously from the "24 h" position to the "0 h" position by rotating backwards in the clockwise direction.

Figure 9:
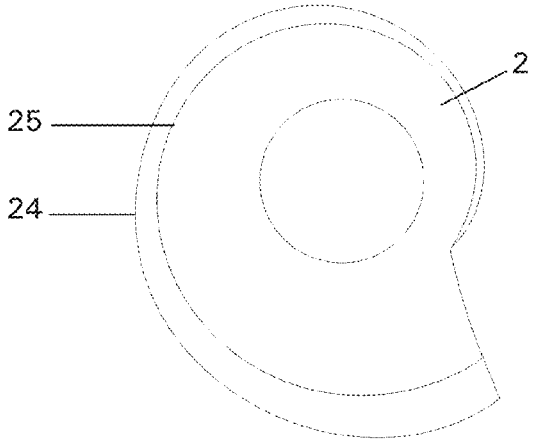
FIG. 9 shows an adapted cam profile of the device from FIG. 1 and an initial cam profile.

The return spring 5 is sized so as to be as stiff as possible upon rotation of the cam 2 in the forward direction (the counter-clockwise direction in the particular example described). However, this stiffness is limited by stresses within the material and by the permissible torque on the cam 2 during reverse correction of the hour. In fact, the stiffness of the spring 5 must not be too high, because this would require high forces to enable movement of the flank 23. As a result of this, when, in normal operation, the cam 2 rotates in the forward direction, the return spring 5 is prestressed and is deformed slightly by the action of the cam 2 on the follower 3. This prestressing and this deformation depend on the action exerted by the spring 6 urging the lever toward the stop 7. Moreover, this action itself depends on the position of the lever relative to the stop. This deformation induces a temporal offset in the display by the hand 1 relative to the display by a hand connected to a mechanism including a follower mounted rigidly on a lever. This temporal offset is quantifiable and corresponds to a given duration, for example 1 h. It is compensated by adapting the cam profile 24. In other words, the cam profile 24 is adapted, i.e. modified relative to a so-called "initial" cam profile 25 used with an analogous but totally rigid mechanism (follower, spring and lever). FIG. 9 shows the initial cam profile 25 and the cam profile 24 of the display device from FIG. 1. The two cam profiles 24, 25 substantially correspond to an Archimedes spiral.

Operation in Reverse Correction Phase:

A reverse correction consists in correcting the display in the counter-clockwise direction. Operation in the reverse correction phase is described with reference to FIGS. 5 to 7C.

For reverse correction of the display, the cam 2 is driven in rotation in a second or counter-clockwise direction called the "reverse direction".

Driven by the follower 3 bearing against the cam 2, the lever 4 drives the hand 1 in rotation in the clockwise direction.

As the follower 3 moves along the cam profile 24 from the apex of the cam 2 to the base of the cam flank 23, the hand 1 moves from the "24 h" position to the "0 h" position. When the hand 1 is in the "0 h" position, the cam follower 31 is positioned at the base of the cam flank 23 and the lever 4 bears against the stop 7.

Figure 5:
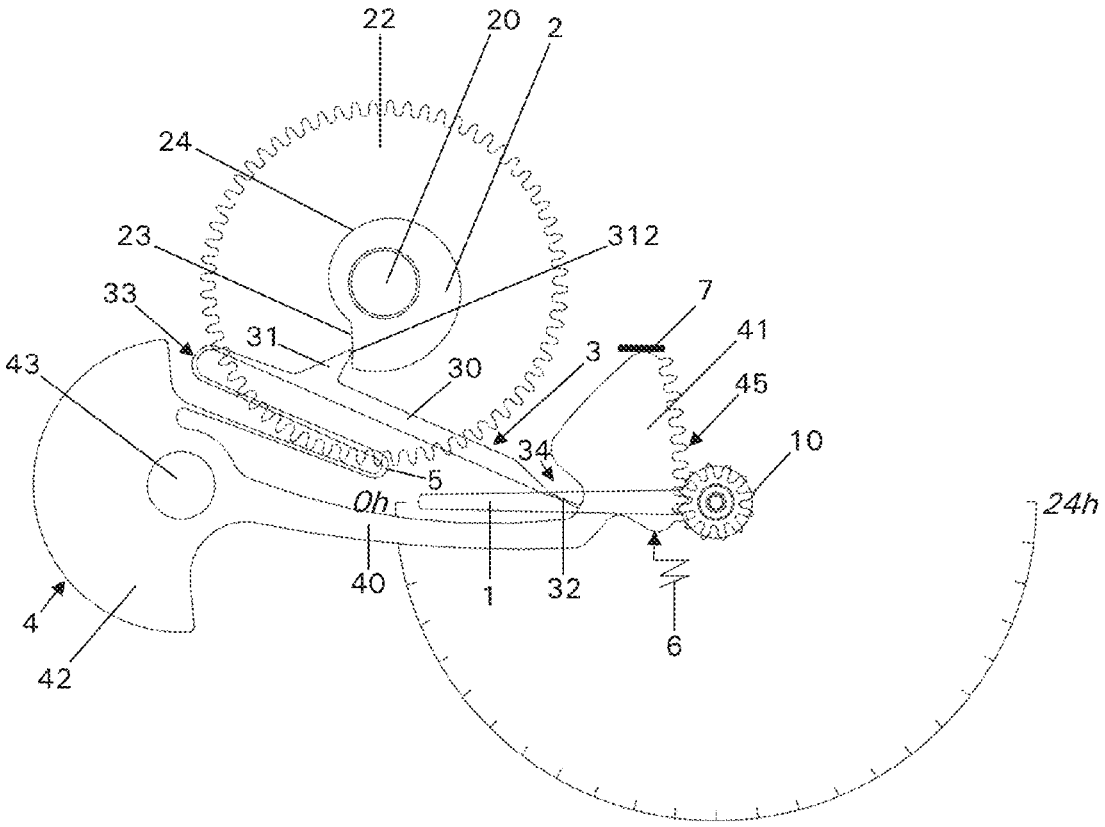
FIG. 5 shows the display device from FIG. 1 when the follower is ascending a cam flank.

Once the position at the base of the cam flank 23 has been reached, the follower head 31 ascends the cam flank 23 again, the tip 312 of the head 31 being in contact with the flank 23. FIG. 5 shows the display device during the ascent of the flank 23. During the ascent the cam flank 23, the latter exerts an action force $\vec{F}$ on the follower head 31, as shown in FIG. 7C. The follower head 31 exerts a reaction force $\vec{F'}$ on the cam flank 23. This action force $\vec{F}$ or the reaction force $\vec{F'}$ has two effects:

- on the one hand, it acts to cause the follower 3 to pivot about the point 32 relative to the lever 40, which brings about retraction of the follower 3, i.e. movement of the follower 3 toward the lever arm 40, against the return action of the spring 5, which is compressed;
- on the other hand, it acts to drive pivoting of the lever 4 against the stop 7, which brings about immobilization of the lever 4.

Thus the action force $\vec{F}$ moves the follower 3 towards the arm 40 of the drive lever 4 and therefore retracts the follower 3 against the return action of the spring disposed between the follower 3 and the lever 4. Retraction of the follower 3, here by pivoting about the pivot point 32, enables ascent of the flank 23 without damaging the mechanism.

Immobilizing the lever 4 during the ascent of the flank 23 enables immobilization of the hand 1 and prevents an erroneous indication by the hand 1 during the ascent of the flank 23.

Figure 6A:
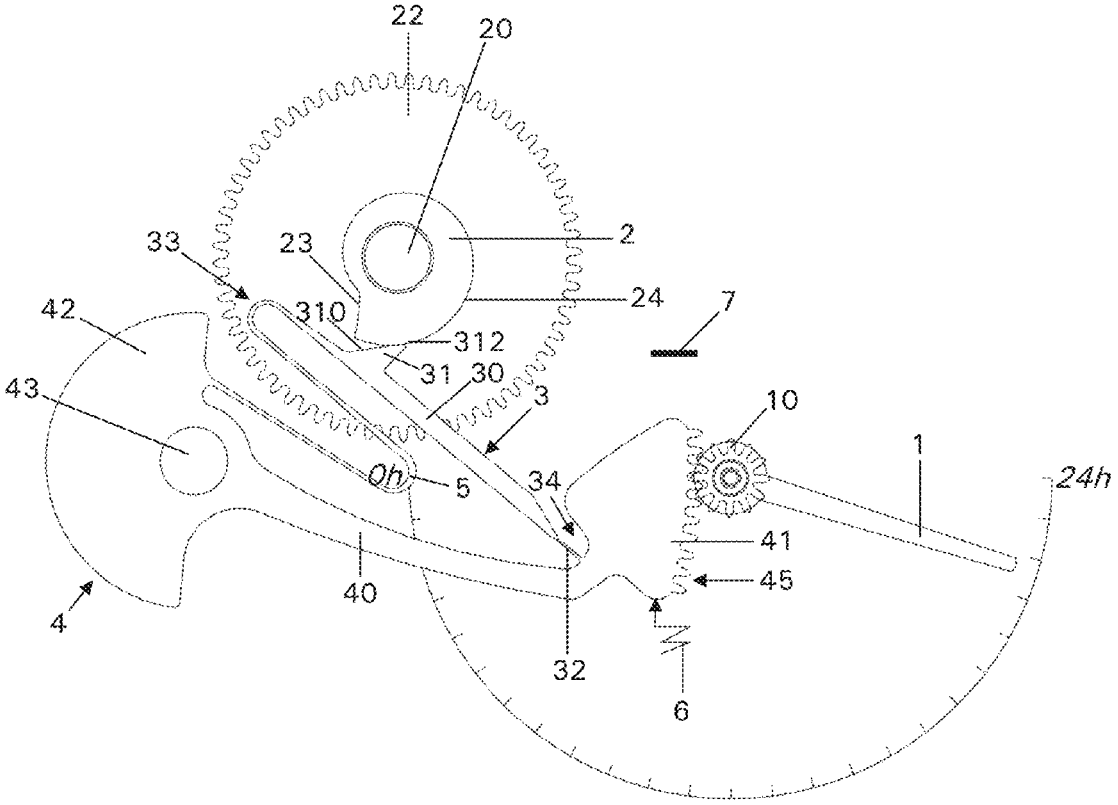
FIGS. 6A and 6B show the display device from FIG. 1 just after the ascent of the cam flank.
Figure 6B:
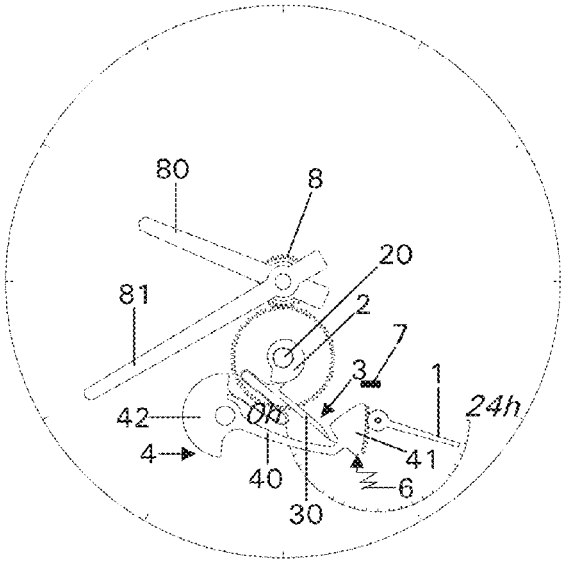

Once the top of the flank 23 is reached, the hand 1 is instantaneously in a display position synchronized with the position of the main hour and minute hands 30 and 40, as shown in FIGS. 6A and 6B.

In normal operation, the stop 7 immobilizes the lever 4 at the end of the descent of the flank 23 and therefore immobilizes the hand in the "0 h" position just after midnight, following its "retrograde" return from the "24 h" position. Furthermore, during the ascent of the flank 23 in the reverse correction phase, the stop 7 also immobilizes the lever 4 in a stable manner and therefore immobilizes the hand 1 in the "0 h" position. Thanks to this, the hand 1 is perfectly stable during the ascent of the flank 23.

Figure 7A:
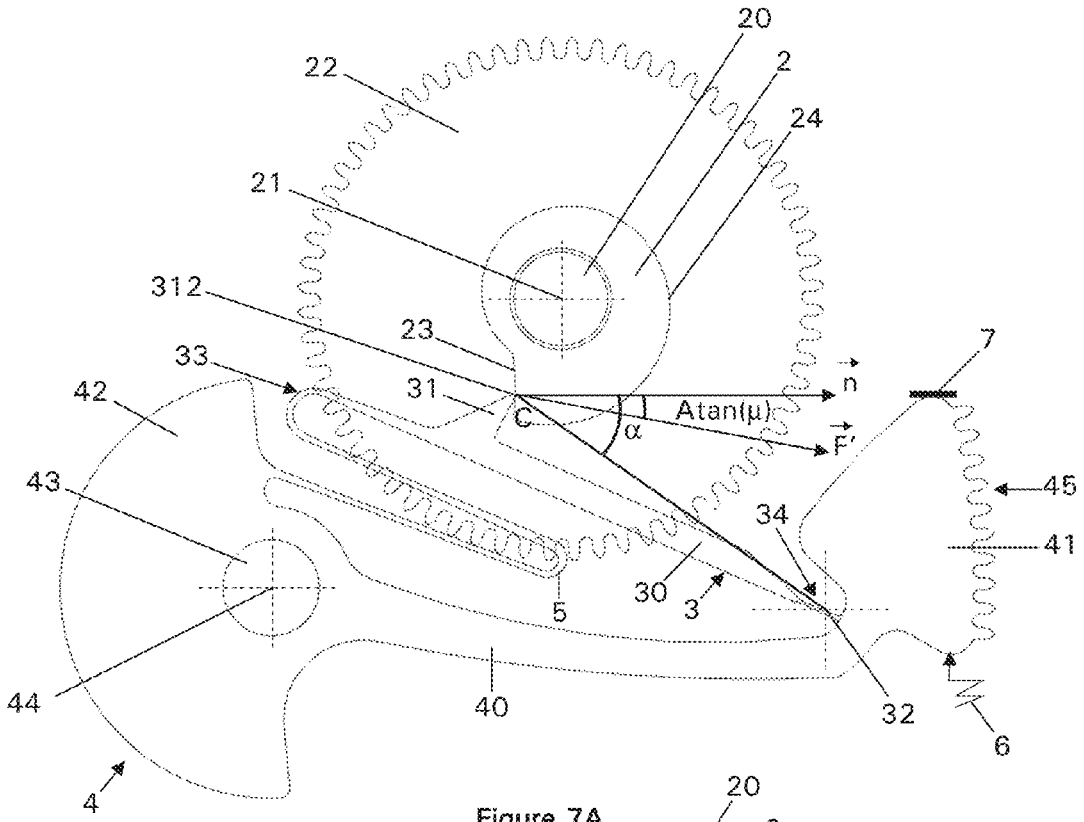
FIG. 7A shows the display device from FIG. 1 when the follower is ascending a cam flank, showing the reaction force of the follower on the cam.
Figure 7B:
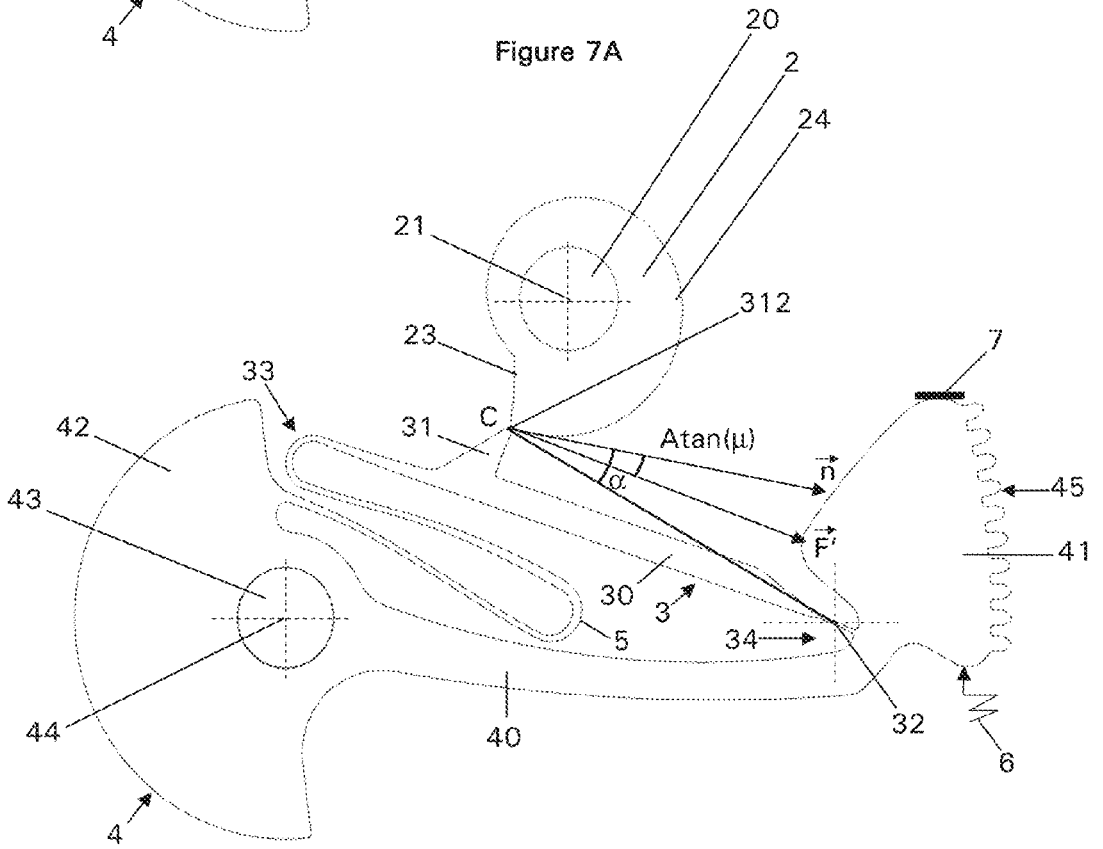
FIG. 7B shows the display device from FIG. 1 at the end of the follower ascending the cam flank when the latter reaches the apex of the cam, showing the reaction force of the follower on the cam.
Figure 7C:
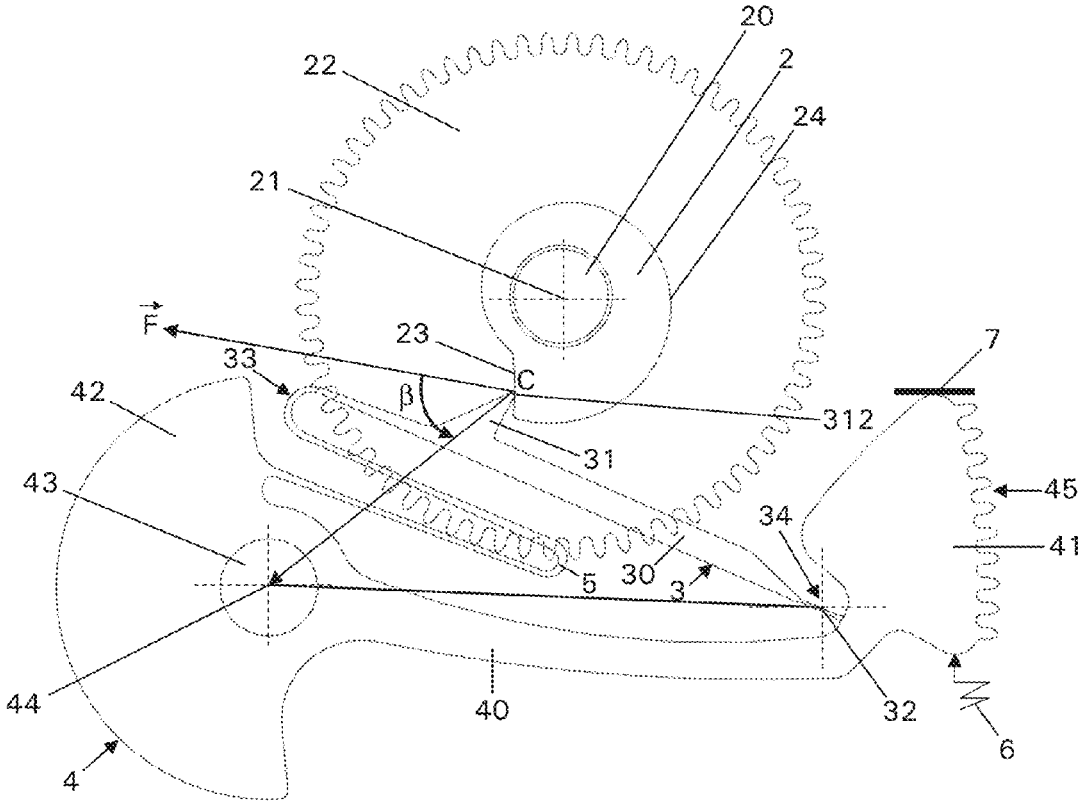
FIG. 7C shows the display device from FIG. 1 when the follower is ascending the cam flank, showing the action force of the cam on the follower.

FIGS. 7A to 7C show the action force vector $\vec{F}$ of the cam flank 23 on the follower head 31 and the reaction force vector $\vec{F'}$ of the follower tip 312 on the flank 23 when the follower head 31 ascends the flank 23. The point C represents the point of contact between the follower head 31 and the flank 23. The vector $\vec{n}$ represents the normal to the flank 23 at the contact point C.

FIGS. 7A and 7B show, respectively during and at the end of the ascent of the flank 23 (when the follower tip 312 reaches the top of the cam 2):

the reaction force $\vec{F'}$, the vector $\vec{n}$, the line segment [C32] connecting the contact point C and the pivot point 32 of the follower 3, the angle $\alpha$ defined by the normal $\vec{n}$ and the line segment [C32] joining the contact point C and the pivot point 32, the angle Atan($\mu$) defined by the normal $\vec{n}$ and the reaction force $\vec{F'}$, corresponding to the arc-tangent of the coefficient of friction $\mu$ between the tip 312 of the follower head 31 and the cam flank 23.

The angle $\alpha$ varies as the follower tip 312 ascends the flank 23. The pivot point 32 is defined so that this angle $\alpha$ is greater than the angle Atan($\mu$) throughout the ascent of the flank 23 by the follower head 31. The moment at which the angle $\alpha$ is smallest and tending toward the angle Atan($\mu$) corresponds to the moment at which the tip 312 reaches the apex of the cam 2 (in other words the top of the flank 23), as shown in FIG. 7B. The pivot point 32 is thus determined so that at the moment the tip 312 reaches the apex of the cam 2 the angle $\alpha$ is greater than the angle Atan($\mu$) and therefore allows pivoting of the follower 3 relative to the lever 4. Referring to FIG. 7B, it will be noted that when the follower tip 312 reaches the apex of the cam 2 the return spring 5 is compressed to the maximum.

FIG. 7C shows:

the contact point C, the action force $\vec{F}$, the line segment [C44] between the contact point C and the pivot point 44 of the lever 4, the line segment [44-32] between the pivot point 44 of the lever 4 and the pivot point 32 of the follower 3, the oriented angle $\beta$ defined between the action force $\vec{F}$ and the line segment [C44], where $\beta=(\vec{F},[C44])$, or the line containing this line segment.

The pivot point 44 of the lever 4 is defined so that the action force $\vec{F}$ immobilizes the lever 4 or causes pivoting of the lever 4, here in the counter-clockwise direction, against the stop 7, the effect of which is to immobilize the lever 4. To this end, and as shown in FIG. 7C, the angle $\beta$ defined by the vectors $\vec{F}$ and $\overrightarrow{C44}$ is positive and less than the value $\pi$:

$$0<\beta<\pi$$

The action force $\vec{F}$ and the angle $\beta$ are located in the half-plane defined by the line segment containing the contact point C and the pivot point 44 of the lever 4 and not containing said lever arm 40. The action force $\vec{F}$ therefore acts to cause the lever 4 to pivot against the stop 7 to immobilize it effectively while the follower 3 ascends the flank 23. The direction of the action force $\vec{F}$ and the side of the pivot point 44 of the lever 4 on which it is applied therefore causes the lever 4 to pivot against the stop 7, thereby immobilizing the lever 4.

In other words, the oriented angle $\beta$ may be defined as being an action angle defined by the action force $\vec{F}$ of the cam on the follower and the line segment [C44] connecting the follower-cam contact point C and the pivot point 44 of the lever 4. This action angle $\beta$ is located in the half-plane defined by the line segment containing this segment [C44] and not containing said lever arm 40. It is preferably between 0° and 180°.

In another embodiment, the action force $\vec{F}$ of the cam 2 on the follower 3 passes substantially through the pivot point 44 of the lever 4; in other words the action angle $\beta$ has the value 0. In this configuration, the action force $\vec{F}$ acts to immobilize the lever 4 without causing it to pivot against a stop.

In the preceding description, the follower 3, the lever 4 and the spring 5 are in one piece. FIG. 10 shows another one-piece embodiment which differs from that just described in terms of the shape of the flexible blade 5, which with the arm of the follower defines a U-shape.

Alternatively, the display device could comprise an assembly including a lever 4 on which is pivoted a follower 3. FIG. 11 shows by way of illustration one particular example of such an embodiment. The follower 3 is pivotably mounted on the lever 4 by means of a pivot. The return spring 5 disposed between the lever 4 and the follower 3 takes the form of a flexible blade.

Here the latter is fastened to the lever 4 at one of its ends and bears against the arm 30 of the follower 3 at its other end. In operation, during the ascent of the cam flank 23, the head 31 of the follower 3 and the portion of the arm 30 carrying the head 31 move toward the lever arm 40 against the return action of the spring 5, thereby bringing about retraction of the follower 3 because of the action of the force $\vec{F}$ exerted by the cam flank 23.

In the preceding description, the cam flank 23 is substantially straight. Alternatively, it could have a more or less marked curvature notably adapted to guarantee that the action force $\vec{F}$ always passes through the pivot point 44 of the lever 4, or substantially through this pivot point 44, to immobilize the lever 4 (with no pivoting against a stop).

The device, various embodiments of which have just been described, may be employed to indicate in a retrograde manner any time information or information derived from the time (indication of the time in a different time zone, calendar indications such as the date, the day of the week, the month, the phase of the moon, etc.). However, the invention is not limited to a retrograde application but concerns any use involving a lever cooperating with a cam (snail-shaped or otherwise) the profile of which includes at least one flank. The invention could for example be applied to a cam-type perpetual date indicator, such as that described in the document EP0191921 for example, or an instantaneous counter chronograph (i.e. a chronograph in which counting of time indications is instantaneous, for example as described in the document CH702137). Moreover, the invention allows bidirectional driving of the display of time information, whether the latter be indicated in a retrograde manner or not.

The display device of the invention is integrated into a clock movement itself integrated into a timepiece including a basic movement to which the movement of the invention is kinematically coupled. The invention therefore also concerns the clock movement integrating the display device that has just been described and the timepiece.

The invention claimed is:

1. A device for displaying time information with the aid of an indicator member, including a cam the profile of which includes a flank;

a lever driving the indicator member;

a follower controlling the lever, pressed against the cam by first spring means, adapted, during movement of the flank in a first direction of movement of the cam, to control movement of the lever intended to drive movement of the indicator member, characterized in that wherein the follower controlling the lever (4) is adapted to be moved relative to the lever against the return action of second spring means interposed between the follower and the lever by an action force exerted by the flank of the cam on the follower during movement of the flank in a second direction of movement of the cam.

2. A device as claimed in claim 1, wherein the action force exerted by the flank of the cam on the follower during movement of the flank in the second direction of movement of the cam acts to bring about immobilization of the lever.

3. A device as claimed in claim 1, wherein said action force acts on the lever to bring about an effect of pivoting of the latter against a stop.

4. A device as claimed in claim 3, wherein said stop is adapted to immobilize the lever during movement of the cam in the first direction when the follower reaches the base of the flank.

5. A device as claimed in claim 1, wherein the lever is adapted to pivot about a pivot point and said action force passes substantially through said pivot point of the lever.

6. A device as claimed in claim 1, wherein the drive lever includes an arm driving the indicator member and the angle, called the action angle, defined by the action force of the cam on the follower and the line segment connecting the point of contact of the follower and the cam flank and the pivot point of the lever is located in the half-plane defined by the line segment containing said segment and not containing the arm driving the lever.

7. A device as claimed in claim 1, wherein the cam has a snail-shaped profile, and the follower includes a head provided with a contact tip and a contact flank and is adapted to be in contact:

via said tip of the follower head with the flank of the cam, and via the flank of the follower head with at least a portion of the profile of the snail-shaped cam.

8. A device as claimed in claim 1, wherein the follower is pivotably mounted on the lever.

9. A device as claimed in claim 1, wherein the movement of the cam in the first direction brings about prestressing of the second spring means that is compensated by a cam profile conformed to ensure accurate display of the time information.

10. A device as claimed in claim 1, wherein the second spring means comprise a flexible blade.

11. A device as claimed in claim 1, wherein the lever, the second spring means and the follower are made in one piece.

12. A device as claimed in claim 1, wherein the lever includes a toothed portion adapted to cooperate with the teeth of a pinion driving the indicator member.

13. A clock movement including a display device as claimed in claim 1.

14. A timepiece incorporating the clock movement as claimed in claim 13.

15. A timepiece incorporating the display device as claimed in claim 1.

16. A timepiece as claimed in claim 15, which comprises a basic movement and the display device as claimed in claim 1, the cam of the display device being driven by the basic movement.

17. A device for displaying time information with the aid of an indicator member, including a cam the profile of which includes a flank;

a lever driving the indicator member;

a follower controlling the lever, pressed against the cam by first spring means, adapted, during movement of the flank in a first direction of movement of the cam, to control movement of the lever intended to drive movement of the indicator member, characterized in that wherein the follower controlling the lever (4) is adapted to be moved relative to the lever against the return action of second spring means by an action force exerted by the flank of the cam on the follower during movement of the flank in a second direction of movement of the cam, and wherein the action force exerted by the flank of the cam on the follower during movement of the flank in the second direction of movement of the cam acts to bring about immobilization of the lever.

18. A device as claimed in claim 17, wherein the second spring means is separate from the first spring means.

19. A device for displaying time information with the aid of an indicator member, including a cam the profile of which includes a flank;

a lever driving the indicator member;

a follower controlling the lever, pressed against the cam by first spring means, adapted, during movement of the flank in a first direction of movement of the cam, to control movement of the lever intended to drive movement of the indicator member, characterized in that wherein the follower controlling the lever (4) is adapted to be moved relative to the lever against the return action of second spring means by an action force exerted by the flank of the cam on the follower during movement of the flank in a second direction of movement of the cam, and wherein the lever is adapted to pivot about a pivot point and said action force passes substantially through said pivot point of the lever.

20. A device as claimed in claim 19, wherein the second spring means is separate from the first spring means.

* * * * *